United States Patent [19]

McClung

[11] 4,261,788

[45] Apr. 14, 1981

[54] ROLLER AND LABEL APPLICATOR INCORPORATING THE SAME

[76] Inventor: Jack P. McClung, 12117 E. Orange Dr., Whittier, Calif. 90601

[21] Appl. No.: 46,463

[22] Filed: Jun. 7, 1979

Related U.S. Application Data

[63] Continuation-in-part of Ser. No. 868,398, Jan. 10, 1978, abandoned.

[51] Int. Cl.[3] ..... B65C 9/18

[52] U.S. Cl. ..... 156/541; 29/116 R; 226/194; 308/189 R; 403/DIG. 4; 403/DIG. 6

[58] Field of Search ..... 29/116 R, 117; 74/527; 403/DIG. 4, DIG. 6, 1, 361, 109, 96, 93, 165, 164; 301/120, 121, 119; 308/18, 207 R, 208, 190, 215, DIG. 2, 189; 226/191, 194, 190; 156/542, 541, DIG. 33

[56] References Cited

U.S. PATENT DOCUMENTS

| | | | |
|---|---|---|---|
| 277,425 | 5/1883 | Patterson | 301/120 |
| 353,218 | 11/1886 | Harrington | 301/120 |
| 1,534,800 | 4/1925 | Malusz | 226/194 |
| 1,741,969 | 12/1929 | Bellows | 403/DIG. 6 |
| 2,186,695 | 1/1940 | Harris | 19/141 |
| 2,766,473 | 10/1956 | Thackara | 403/165 |
| 2,781,237 | 2/1957 | Masse | 19/141 |
| 2,988,257 | 6/1961 | Lasarev et al. | 226/187 |
| 3,107,947 | 10/1963 | Hulterstrum | 308/8 |
| 3,457,137 | 7/1969 | McCarthy | 156/542 |
| 3,537,631 | 11/1970 | Fuji | 226/191 |
| 3,639,980 | 2/1972 | Muse | 30/102 |
| 3,713,064 | 1/1973 | Smolka et al. | 74/527 |
| 3,729,362 | 4/1973 | French et al. | 156/542 |
| 3,840,164 | 10/1974 | Takenaka et al. | 226/90 |

*Primary Examiner*—Michael W. Ball
*Attorney, Agent, or Firm*—Dominick Nardelli

[57] ABSTRACT

A roller comprising an elongated shaft and a roller assembly mounted for rotation on the elongated shaft. The roller assembly is retained on the shaft by a detent which is resiliently urged radially inwardly so that a portion of the detent is received in an annular groove on the shaft. This does not interfere with the rotation of the roller assembly on the shaft and it facilitates rapid installation and removal of the roller assembly. A roller of this type may be used, for example, as one of the rollers for a label applicator of the type which feeds labels carried by a backing strip.

10 Claims, 9 Drawing Figures

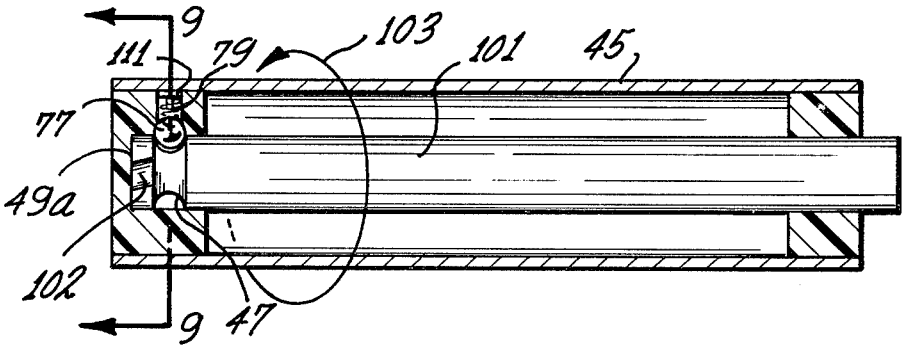
FIG. 8
FIG. 9
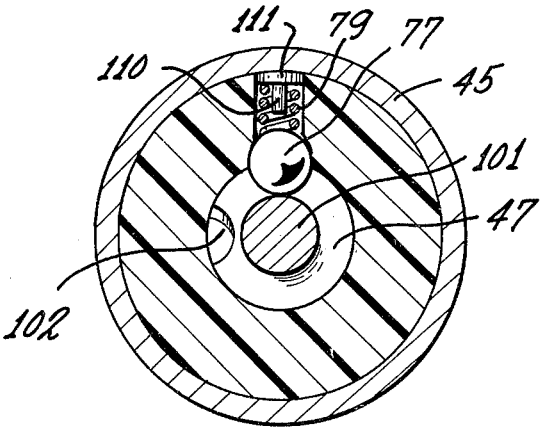

ROLLER AND LABEL APPLICATOR INCORPORATING THE SAME

This application is a continuation-in-part of my copending U.S. Patent Application Ser. No. 868,398, filed on Jan. 10, 1978.

BACKGROUND OF THE INVENTION

Rollers are used for many purposes, such as guiding or moving various sheet materials, such as strip fed labels, recording tape, and other materials. For example, many label applicators are of the type which use labels which are adhered to an elongated backing strip. The label applicator removes the labels from the backing strip and applies them to articles being conveyed past the label applicator.

The label supplying means of the label applicator typically includes several rollers over which the backing strip passes in moving from a supply reel to a take-up reel. Not infrequently, it is necessary to replace one or more of these rollers. Roller replacement may be required as a result of various factors, including damage to one of the rollers, a need for a different length or diameter roller, cleaning of the rollers, etc. Roller cleaning is required more frequently when labeling products for human consumption. Other items of equipment also require roller replacement for similar reasons.

In order to replace a roller, it is necessary to shut down, not only the label applicator, but the entire production line. It is, of course, important to minimize the downtime of the production line. Unfortunately, prior art rollers require a substantial amount of time for removal and installation. For example, some prior art rollers are attached by various forms of fasteners, including snap rings, all of which require appreciable time for roller removal and installation. Consequently, as a result of using prior art rollers on label applicators, the downtime of the production line is much greater than it should be.

SUMMARY OF THE INVENTION

This invention provides a roller which includes an elongated shaft and a roller assembly rotatably mounted on the shaft. The roller assembly is held on the shaft by quick release means which do not interfere with rotation of the roller assembly on the shaft. Accordingly, the roller assembly can be rapidly removed and installed on the shaft as may be necessary, and downtime resulting from this operation is minimized.

The roller assembly can advantageously include a sleeve having inner and outer ends and a passage within the sleeve opening at the inner end of the sleeve. The sleeve can be open at one or both ends. The sleeve has an outer peripheral surface which is adapted to contact the material being worked upon, such as the backing strip for the labels. Accordingly, the outer peripheral surface of the sleeve is preferably a smooth, cylindrical surface.

The roller assembly also includes bearing means for mounting the sleeve on the shaft for rotation. The bearing means can advantageously be mounted in the passage of the sleeve and be coupled to the sleeve. To permit the bearing means to receive the shaft, the bearing means has an opening therein.

The bearing means can be any kind of bearing suitable for rotatably mounting the sleeve on the shaft. For example, the bearing means may include ball bearings or sleeve bearings made of a suitable metal or plastic.

The bearing means may include one or more bearings of an appropriate kind depending upon the anticipated duty of the roller. For many applications, the bearing means may include inner and outer bearings mounted in the passage of the sleeve with the inner bearing being located axially inwardly of the outer bearing. With this construction, the shaft is slidably insertable into the passage of the sleeve and into the openings in the bearings, and when so inserted, the sleeve can rotate on the shaft.

An important feature of the invention is the manner in which the roller assembly is retained on the shaft. This function is carried out by detent means which cooperates with a groove to releasably retain the roller assembly on the shaft to facilitate installation and removal of the roller assembly. The detent means can advantageously include a detent, means for resiliently urging the detent into the groove, and means for mounting the detent and the resilient means. The groove can be on the shaft or the roller assembly, but in either case, the groove circumscribes the shaft. The means for mounting the detent and the resilient means are on either the shaft or roller assembly, whichever does not have the groove. Preferably, the groove is on the shaft and the detent is carried by the roller assembly. With this construction, the roller is releasably held on the shaft by a portion of the detent which is received in the groove. Because the groove circumscribes the shaft, this interlock between the detent and the groove does not interfere with rotation of the sleeve on the shaft.

To remove the roller assembly, an axial outward pulling force is applied to it. This moves the detent against the biasing action of the spring to permit snapoff removal of the roller assembly. By applying an axial inward force to the roller assembly, the detent is snapped into the groove to thereby install the roller assembly on the shaft. Thus, in a matter of seconds, one roller assembly can be replaced with another.

To assure that the sleeve is as free-wheeling on the shaft as possible, the groove should receive the detent with axial and radial clearance. However, this clearance is preferably not so great as to allow a substantial amount of "play" of the roller assembly on the shaft. In addition, the detent is preferably retained on the roller assembly by means other than the shaft against the resilient biasing action of the resilient means. Thus, the detent is not normally resiliently urged into contact with the shaft.

The detent and the resilient means can be provided in a bore in the bearing means or in a bore in a separate member provided for the purpose of detent retention. In either event, the bore preferably extends radially and has a shoulder near the location where it opens on the inner periphery of the bearing means or member for the purpose of retaining the detent in the bore. Although the shoulder can be formed in various different ways, it can advantageously be formed by stopping the bore forming tool before the full cross-sectional area of the tool passes through the arcuate inner peripheral surface of the member or bearing means. This will provide an elliptical shaped opening on the arcuate inner periphery to thereby form shoulders for retaining the detent in the bore.

One shaft can be used to mount roller assemblies of different lengths so long as the bearing means and the detent mounting means are appropriately located on the roller assemblies. The groove is preferably located adjacent the outer end of the shaft, although it may be located at virtually any position along the shaft.

When ball bearings are used for the bearing means, a separate member can advantageously be provided for retaining the detent and the resilient biasing means for the detent. This additional member may be a sleeve bearing or a member which performs little or no bearing function and is provided primarily, or entirely, for detent retention purposes.

The invention, together with further features and advantages thereof, may best be understood by reference to the following description taken in connection with the accompanying illustrative drawing.

BRIEF DESCRIPTION OF THE DRAWING

FIG. 8 is an elevational view partially in section similar to FIG. 2 showing another embodiment of the shaft onto which the roller assembly may be mounted.

FIG. 9 is a sectional view taken on line 9—9 of FIG. 8 taken in the direction of the arrows.

DESCRIPTION OF THE PREFERRED EMBODIMENTS

Figure 1:
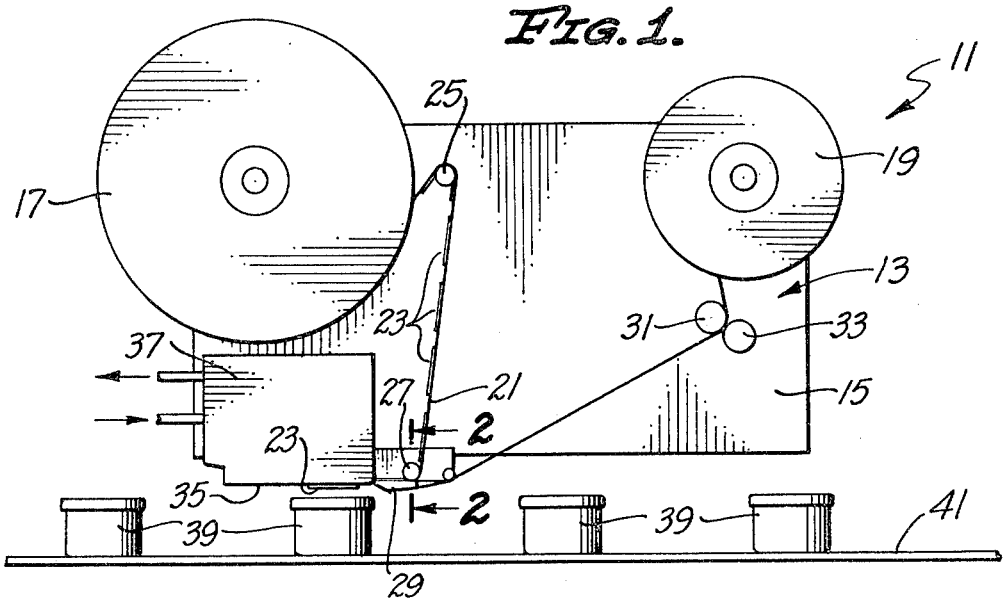
FIG. 1 is a somewhat schematic elevational view of a label applicator of the type which may employ the roller of this invention.

FIG. 1 shows a label applicator 11 of the type which may utilize rollers of the kind shown, by way of example, in FIGS. 2, 6, 7 and 8. The label applicator 11 is merely illustrative of the kind of apparatus which may utilize the roller of this invention and is further merely illustrative of the label applicator which may employ these rollers.

The label applicator includes a supporting structure 13 which in turn includes a mounting plate 15. A storage reel 17 and a take-up reel 19 are rotatably mounted on the supporting structure 13. A web or backing strip 21 having labels 23 adhered thereto is wound on the storage reel 17 and extends over a dancer roller assembly 25, guide roller assembly 27, a peeling bar 29 and between a pinch roller assembly 31 and a drive roller 33 to take-up reel 19. The number and placement of the roller assemblies 25, 27, 31 and 33 is merely illustrative. The drive roller rotates to pull the backing strip 21 off of the storage reel 17, and the take-up reel 19 is caused to rotate in accordance with the amount of the backing strip 21 which is supplied thereto. Typically, the backing strip 21 is moved intermittently.

As the backing strip 21 is drawn across the peeling bar 29, the label at the peeling bar is removed and applied to a grid 35 of a vacuum box 37 where it is retained by subatmospheric pressure within the vacuum box. Articles 39 are conveyed past the label applicator 11 by a conveyer 41. When one of the articles 39 is below the label 23 on the grid 35, the label is transferred by any suitable means, such as a blast of air or a tamping mechanism to the article 39. The adhesive on the label 23 retains it on the article 39.

The construction and operation of label applicators, such as the label applicator 11, are well known in the label applicating field. In fact, the label applicator 11 may be of conventional construction, except for one or more of the roller assemblies 25, 27 and 31.

Figure 2:
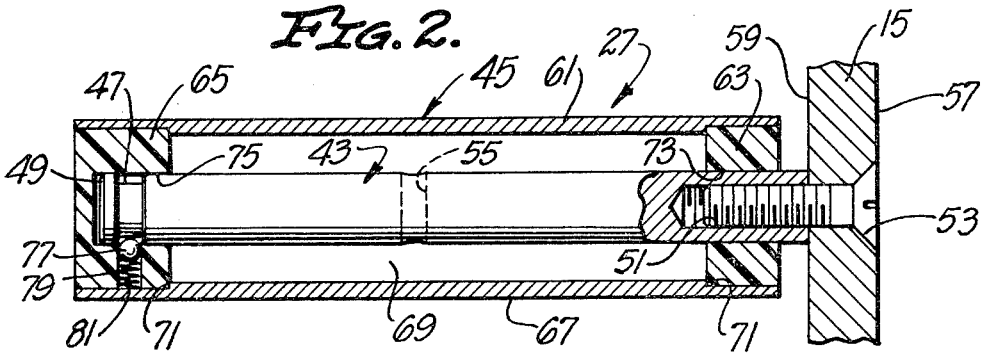
FIG. 2 is an enlarged fragmentary sectional view taken generally along line 2—2 of FIG. 1 and illustrating a preferred roller construction.
Figure 3:
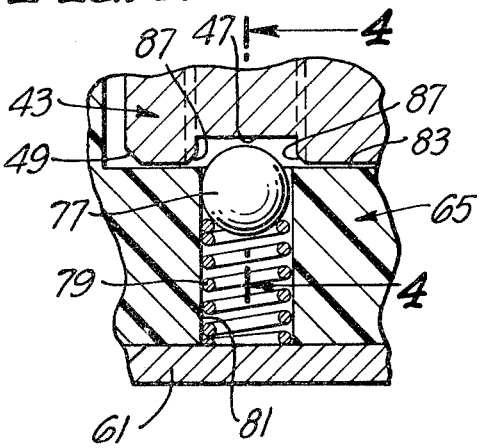
FIG. 3 is an enlarged fragmentary sectional view of the portion of FIG. 1 around the detent, the groove and the shaft.
Figure 4:
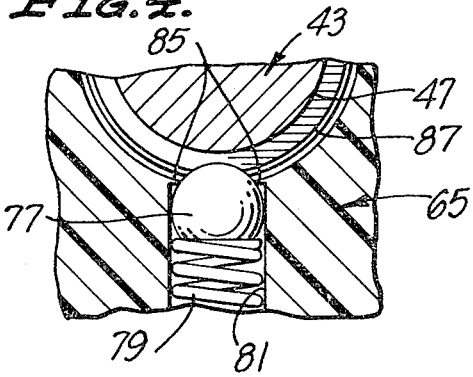
FIG. 4 is an enlarged fragmentary sectional view taken generally along line 4—4 of FIG. 3.

The construction of one of the guide roller assembly 31 is shown, by way of example, in FIGS. 2–4. The other guide roller 27, the dancer roller 25 and the pinch roller 31 may be of identical construction.

The guide roller assembly 27 generally includes a shaft 43 and a roller 45. The shaft 43 has inner and outer ends and a groove 47 which circumscribes the shaft 43. Preferably, the groove 47 is annular and is adjacent the outer end of the shaft. Except for the groove 47, the shaft 43 is cylindrical and has a beveled edge 49 at the outer end thereof. The shaft 43 can be constructed of various materials, including metal and plastic, and in the embodiment illustrated, is constructed of stainless steel.

To attach the inner end of the shaft 43 to the mounting plate 15, the shaft 43 has a threaded axial bore 51 which is adapted to receive a screw 53 which also passes through an aperture in the mounting plate 15. A radial bore 55 is provided in the shaft 43 to receive a tool to facilitate tightening of the screw 53. It should be noted that the mounting plate 15 has an inner face 57 which may be enclosed, or partially enclosed, and which is relatively inaccessible and an outer face 59 from which the shaft 43 projects. The inner end of the shaft 43 is drawn up into tight engagement with the outer face 59 of the mounting plate 15.

The roller 45 includes a sleeve 61 and bearing means, which in the embodiment illustrated, includes an inner bearing 63 and an outer bearing 65. The sleeve 61, because of its intended use must have a smooth, cylindrical outer peripheral surface 67 and of course an axial passage 69 extending completely through the sleeve. The opposite ends of the passage 69 have counterbores defining annular shoulders 71. Although other materials can be used, in the embodiment illustrated, the sleeve 61 is constructed of a metal, such as sluminum.

In the embodiment illustrated, the bearings 63 and 65 are passed into the inner and outer ends of the passage 69 into engagement with the shoulders 71 to fixedly mount the sleeve 61 on the bearings. Although different kinds of bearings can be used, each of the bearings 63 is a sleeve bearing constructed of a suitable plastic material, such as nylon or Delrin. Of course, other materials including metal, such as bronze, can be used for the bearings 63 and 65. The bearings 63 have an axial opening 73 extending completely therethrough, and the bearing 65 has a blind axial bore or opening 75. Thus, the bearing 65 also serves to close the outer end of the sleeve 61, protecting the bearing surfaces form dirt.

With this construction, the roller assembly 45 can be slid over the shaft 43 with the shaft 43 extending through the opening 73 and into the opening 75 to thereby coaxially mount the roller assembly 45 on the shaft 43. The bearings 63 and 65 mount the sleeve 61 for rotation on the shaft 43.

exposed within the passage 69 of the sleeve 61. Detent means cooperates with the groove 47 to releasably retain the roller assembly 45 on the shaft 43. In the embodiment illustrated, the detent means includes a detent 77, resilient means in the form of a coil compression spring 79, and means in the form of a bore 81 in the bearing 65 for mounting the detent and the spring on the roller assembly for rotation with the sleeve 61.

The details of construction of the detent means can best be seen in FIGS. 3 and 4, and except for the detent means, the roller 27 is basically of conventional construction. The bore 81 is generally cylindrical bore extending radially from the outer periphery of the bearing 65 to an arcuate inner peripheral surface 83. Shoulders 85 integral with the bearing 65 at the inner end of the bore 81 hold the detent 77 in the bore with only a predetermined portion of the detent projecting out of the bore 81. The spring 79 bears at one end on the sleeve 61 (FIG. 2) and at the other end on the detent 77 to resiliently load the detent against the shoulder 85. Although the detent 77 could be of different configurations, in the embodiment illustrated, it is in the form of a spherical metal ball.

The groove 47 is larger than the portion of the detent 77 which it receives. Thus, as best seen in FIG. 3, the groove 47 is large enough to receive the detent 77 with both axial and radial clearance. The axial and radial clearance may be, for example, 0.001 to 0.002 inch. With this construction, the spring 79 does not load the detent 77 against the shaft 43. In addition, the groove 47 preferably has beveled edges 87 to reduce unit loading of the detent 77 against the shaft 43 when the detent contacts the shaft 43. The outer bevel edge 87 also aids in the replacement of a roller 45 on the shaft 43.

Figure 5:
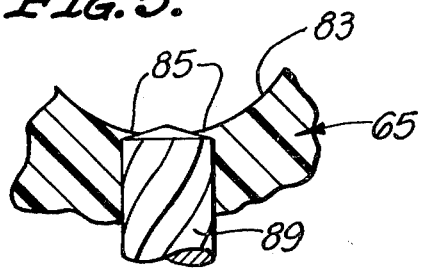
FIG. 5 is a fragmentary sectional view showing a prefered way for forming the shoulder for retaining the detent in the bearing.

Although the shoulders 85 can be formed in different ways, they are advantageously formed as shown in FIG. 5 by advancing a boring tool 89 radially inwardly from the outer periphery of the bearing 65 toward the arcuate inner peripheral surface 83. By stopping the radial advance of the boring tool 89 in the position shown in FIG. 5 before the full cross-section area of the tool passes through the arcuate inner peripheral surface 83, shoulders 85 are inherently formed. In this manner, the shoulders 85 are inherently formed as part of the boring operation and no separate work operation for shoulder formation is required.

With the roller assembly 45 mounted on the shaft 43 as shown in FIG. 2, the bearing 63 and 65 mount the entire roller assembly 45 for rotation of the shaft. The detent 77 rides in the annular groove 47 and does not interfere with rotation. The bearings 63 and 65 take the radial thrust on the sleeve 61 and the detent 77 cooperates with the groove 47 to releasably retain the roller assembly 45 on the shaft 43.

To remove the roller assembly 45, an axial outward pulling force is exerted on the roller of sufficient magnitude to cam the detent 77 radially outwardly against the biasing force of the spring 79. To replace the roller assembly 45 on the shaft 43, the new roller assembly is slid over the shaft and the beveled edge 49 on the shaft cams the detent 77 radially outwardly in response to an axial inward force to permit the detent 77 to snap into the annular groove 47. In the same manner that beveled edge 49 acts to facilitate insertion of the roller 45 onto the shaft so does the outer bevel edge 87 facilitate the removal of the roller 42. When the roller assembly 45 is removed from the shaft 43, the bore 55 may be used to tighten or loosen the shaft 43 on the screw 53.

Figure 6:
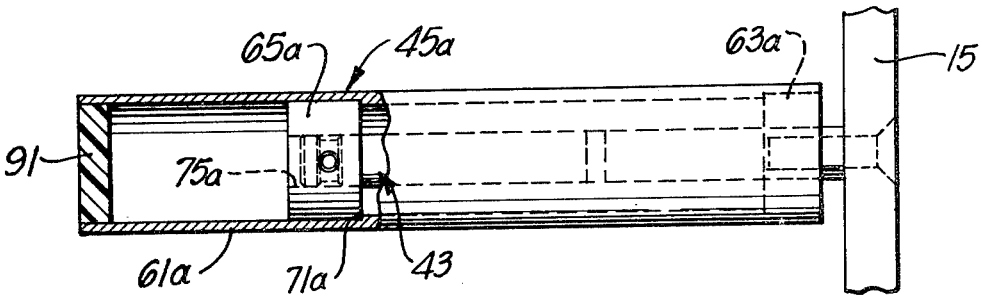
FIG. 6 is an elevation view partially in section similar to FIG. 2 showing a roller having a longer roller assembly.

FIG. 6 shows how the shaft 43 can be used to receive and mount a longer roller assembly **45*a*. Portions of the roller assembly 45*a* corresponding to portions of the roller assembly 45** are designated by corresponding reference numerals followed by the letter "a."

The roller assembly **45*a* is identical to the roller assembly 45 in all ways not shown or described herein. The primary differences between the roller assembly 45*a* and the roller assembly 45 is that the opening 75*a* of the bearing 65*a* extends completely through the bearing. In addition, the sleeve 61*a* is longer than the sleeve 61 so the bearing 65*a* is spaced substantially from the outer end of the sleeve. The bearing 65*a* does not close the outer end of the sleeve 61*a*. Rather, a plug 91 is pressed into the outer end of the sleeve 61*a*** to close the outer end of the sleeve.

Figure 7:
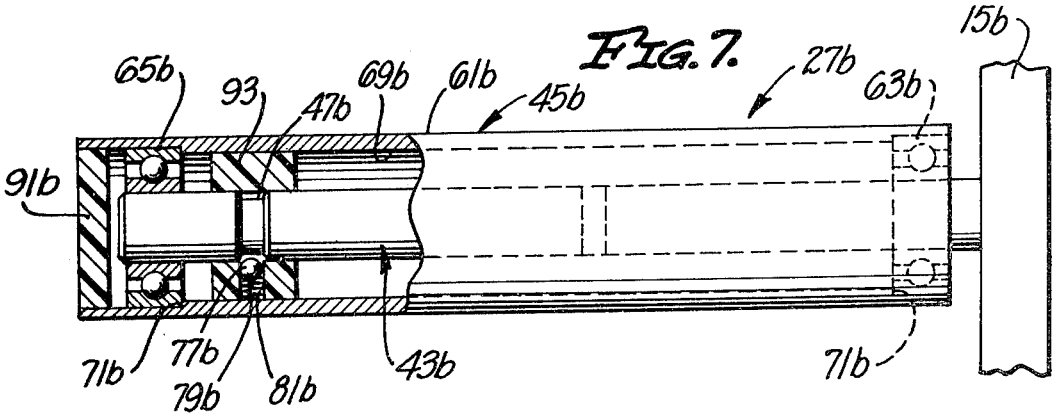
FIG. 7 is a sectional view similar to FIG. 2 showing a roller using a roller assembly which includes two ball bearings.

FIG. 7 shows a guide roller **27*b* which is identical to the guide roller 27 in all ways not specifically shown or described herein. Portions of the roller 27*b* corresponding to portions of the roller 27 are designated by corresponding reference numerals followed by the letter "b." The shaft 43*b* is identical to the shaft 43, except that the annular groove 47*b* is spaced farther from the outer end of the shaft. The sleeve 61*b* is identical to the sleeve 61, except the counterbore at the outer end of the sleeve 61*b* which defines the outer annular shoulder 71*b*, is of increased length. The bearings 63*b* and 65*b* are ball bearings and have their outer races pressed into the sleeve 61*b* in engagement with the shoulders 71*b*. The inner races of the ball bearings 63*b* and 65*b* slidably receive the shaft 43*b*. The outer end of the sleeve 61*b* is closed by a plug 91*b***.

The detent **77*b* and the spring 79*b* are held in a bore 81*b* in a member 93. Although the member 93 need not be a bearing, in the embodiment illustrated in FIG. 7, it is a sleeve bearing identical to the bearing 65*a* (FIG. 6) and it is suitably retained within the passage 69*b***.

The embodiment of FIG. 7 is adapted for use where the radial loads on the roller assembly **45*b* are relatively high. Of course, the roller assembly 45*b* can be quickly changed as described above with reference to FIG. 2**.

In FIGS. 8 and 9 the roller 45 may be identical to rollers 45, **45*a* and 45*b*, described above, but the shaft 101 includes a new feature. The new feature is that the roller 45 is now more difficult to be removed, thereby preventing accidental disassembly when rotating at high speeds. This is accomplished by forming a substantially axially parallel groove 102 in the shaft 101 which groove 102 extends from groove 47 to the outer end 49*a*. In this embodiment bevel 49 of FIG. 2 is removed and the depth of groove 47 is made deeper so that the roller may not be removed unless the ball bearing 77 is axially aligned with groove 102. In this aligned position the roller 45 can be removed by pulling axially thereon causing the ball 77 to lift and pass through the groove 102. To ensure smooth rotation of the roller 45, I have made the depth of groove 102 less than the depth of groove 47 as shown in FIG. 9. Since groove 47 is now preferably made deeper than the depth of the groove 47 of FIG. 2, I have made the bottom of this groove 47 semi-cylindrical as shown in FIG. 8. To prevent the ball 77 from binding therein I have made the radius of the semi-cylinder slightly larger than the radius of the ball 77 so that point contact is made therebetween with a minimum of end play or play in the axial direction. In addition I have placed groove 102 on a helical path so that groove 102 forms a slight angle with respect to the axis thereof. The slope of the helix is such that if the groove 102 is formed on the bases of a left hand screw thread as shown, the roller 45 should rotate counterclockwise or in the direction of arrow 103. Now the shaft 101 and roller 45 would be impossible to become disengaged while rotating. Of course if the roller 45 is to rotate in the opposite direction the groove 102 should form a right hand thread. In other words the helical angle is such that as one progresses along the helix form the free end 49***a* of shaft 101 the helix should rotate in the direction of roller rotation in order to provide this safety feature.

When relatively large diameter rollers such as roller 45 are to be placed on relatively small diameter shafts 101, the length of spring 79 obviously increases but the spring constant remains the same. Then when the roller 45 rotates one may find that the ball 77 may be lifted out of the groove 47, perhaps by centrifugal force. To prevent the ball from moving away from the bottom of groove 47 more than the depth thereof, I have inserted, as shown a pin 110 with a head 111 within the radially disposed bore 81 wherein spring 79 is also disposed. Now spring 79 reacts against the head 111 and the ball 77. However, to ensure that the roller 45 could still be removed the inward end of pin 110 is spaced from the ball a distance that is slightly more than the distance that the bottom of groove 102 is displaced radially outward from the bottom of groove 47.

Although exemplary embodiments of the invention have been shown and described, many changes, modifications and substitutions may be made by one having ordinary skill in the art without necessarily departing form the spirit and scope of this invention.

I claim:

1. A roller assembly comprising:

a cylindrical shaft having one free end and one fixed end;

a cylindrical roller having a smooth cylindrical sleeve with inner and outer ends and with an axial aligned passage within said roller, said passage being at least open as said inner end so that said shaft is capable of being inserted within said passage;

bearing means disposed within said roller for supporting said roller on said shaft for rotation therewith;

detent means for releaseably locking said roller onto said shaft and comprising:

said sleeve;

a bearing having a tubular outer surface and a cylindrical axially aligned hole concentric with said outer surface of and being disposed within said passage of said roller;

the cross section of said passage and the configuration of said outer surface being such that said bearing and said sleeve form an interferance fit therebetween;

the diameter of said axial hole and the diameter of said shaft being such that a free fit is formed therebetween when said shaft is inserted into said sleeve and through said hole to allow for rotation of said sleeve and roller;

said bearing having a radially directed hole wherein the diameter of said radial hole is substantially uniform and converges adjacent said axial hole thereon to form a reduced diameter;

a ball and a spring disposed within said radial hole so that said spring bears against said sleeve and said ball is urged towards the axis of said sleeve and against said reduced diameter therein to allow a portion of said ball to protrude out of said radial hole into said axial hole and the reduced diameter of said radial hole retains the major portion of said ball therein;

said shaft having formed therein a circumferential groove so that when said sleeve is around said shaft said groove protrudes into said axial hole, nests within said groove; and another groove is formed on said shaft extending from its free end to said circumferential groove and communicates therewith.

2. The roller assembly of claim 1 wherein:

said circumferential groove has an axial length slightly longer than the width of the protruding portion of said ball to allow free rotation of said ball around said shaft.

3. The roller assembly of claim 2 wherein:

said circumferential groove is further limited to having sloping beveled edges disposed on both sides thereof.

4. The roller assembly of claim 3 wherein:

said other groove follows a helical path around said shaft.

5. The roller assembly of claim 3 wherein:

said other groove follows a helical path around said shaft.

6. A label applicator for applying labels to articles wherein the labels are supplied on a backing strip, said label applicator comprising:

a supporting structure including a mounting plate;

label supplying means on the supporting structure for moving the backing strip along a path;

means for removing labels from the backing strip;

means for applying the removed labels to articles;

said label supplying means including at least one rotating roller assembly over which the backing strip moves while moving along said path;

said roller assembly including:

a cylindrical shaft having one free end and the other end fixed to said mounting plate with the shaft projecting outwardly from said mounting plate;

a cylindrical roller having a smooth cylindrical sleeve with inner and outer ends and an axial aligned passage within said sleeve, said passage being open at least at said inner end so that said shaft is capable of being inserted within said passage;

bearing means disposed within said sleeve for supporting said roller on said shaft for rotation therewith;

detent means for releaseably locking said sleeve onto said shaft and comprising:

said sleeve;

a bearing having a tubular outer surface and a cylindrical axially aligned hole concentric with said outer surface and being disposed within said passage of said sleeve;

the cross section of said passage and the configuration of said outer surface being such that said bearing and said sleeve form an interference fit therebetween;

the diameter of said axial hole and the diameter of said shaft being such that a free fit is formed therebetween when said shaft is inserted into said sleeve and through said hole to allow for rotation of said sleeve;

said bearing having a radially directed hole wherein the diameter of said radial hole is substantially uniform and converges adjacent said axial hole therein to form a reduced diameter;

a ball and a spring disposed within said radial hole so that said spring urges against said sleeve and said ball is urged towards the axis of said bearing and against said reduced diameter to allow a portion of said ball to protrude out of said radial hole into said axial hole and the reduced diameter of said radial hole retains the major portion of said ball therein;

a circumferential groove formed on said shaft so that when said sleeve is around said shaft said groove is aligned with said ball and the protruding portion of said ball nests within said groove; and another groove is formed on said shaft extending from its free end to said circumferential groove and communicates therewith.

7. The label applicator of claim 6 wherein:

said other groove follows a helical path around said shaft.

8. The label applicator of claim 6 wherein:

said circumferential groove has an axial length slightly longer than the width of the protruding portion of said ball to allow free rotation of said ball around said shaft.

9. The label applicator of claim 8 wherein:

said circumferential groove is further limited to having sloping beveled edges disposed on both sides thereof.

10. The label applicator of claim 9 wherein:

said other groove follows a helical path around said shaft.

* * * * *